United States Patent [19]

Shidner

[11] Patent Number: 4,561,525

[45] Date of Patent: Dec. 31, 1985

[54] UTILITY BAG WITH SUSTAINED OPEN CONFIGURATION

[76] Inventor: Morris C. Shidner, 1374 Ramona St., Ramona, Calif. 92065

[21] Appl. No.: 549,307

[22] Filed: Nov. 7, 1983

[51] Int. Cl.[4] ..... A45C 5/00

[52] U.S. Cl. ..... 190/106; 190/107; 190/109; 190/124; 190/127

[58] Field of Search ..... 190/106, 109, 115, 116, 190/117, 119, 121, 124, 125, 127, 107

[56] References Cited

U.S. PATENT DOCUMENTS

| | | | |
|---|---|---|---|
| 1,430,267 | 9/1922 | Smith | 190/106 |
| 2,123,454 | 7/1938 | Doppelt | 190/106 |
| 2,326,452 | 8/1943 | Freedland | 190/106 |
| 2,509,370 | 5/1950 | Rubin | 190/125 |
| 2,561,042 | 7/1951 | Arnold et al. | 190/125 |
| 2,628,694 | 2/1953 | Kushner | 190/109 |
| 2,661,824 | 12/1953 | Nelson, Jr. | 190/109 |
| 2,901,017 | 8/1959 | Renz et al. | 190/106 |
| 3,099,975 | 8/1963 | Kish, Jr. | 190/115 |
| 3,122,225 | 2/1964 | Ward | 190/109 |
| 3,295,643 | 1/1967 | Peterson et al. | 190/125 |
| 3,477,553 | 11/1969 | Kish, Jr. | 190/119 |
| 3,708,045 | 1/1973 | Katz | 190/115 |
| 3,730,308 | 5/1973 | Pelavin | 190/115 |
| 3,963,102 | 6/1976 | Carp | 190/109 |
| 4,301,898 | 11/1981 | Plough et al. | 190/109 |
| 4,433,760 | 2/1984 | Pelavin | 190/125 |

FOREIGN PATENT DOCUMENTS

| | | | |
|---|---|---|---|
| 1356448 | 2/1964 | France | 190/109 |
| 366132 | 1/1963 | Switzerland | 190/109 |

*Primary Examiner*—Joseph Man-Fu Moy
*Assistant Examiner*—David Fidei
*Attorney, Agent, or Firm*—John J. Murphey

[57] ABSTRACT

A cloth bag having the property of maintaining a sustained open-bag configuration once opened and the sides arranged vertically comprising a flat base, a pair of flexible yet retentive side panels and a pair of supple end panels attached to the base, a flexible yet retentive divider panel attached to the end panels and base to divide the bag into two large compartments, closure means, such as a zipper, to join the side panels together along their top edges and fold back and join the end panel top edges onto themselves to form exterior flaps that are folded down and attached to the end flap near the base and a handle for carrying same.

14 Claims, 4 Drawing Figures

UTILITY BAG WITH SUSTAINED OPEN CONFIGURATION

This invention pertains to the field of cloth containers and like receptacles otherwise known as utility bags. More particularly, this invention pertains to flexible cloth bags generally termed "parachute" bags.

Flexible bags of the "parachute" type are characterized by having a smooth elongated flat base from which a pair of opposed side panels extend upward, joined to a pair of opposed end panels that also extend upward from the base and a closure means arranged along the top edge of the panels to close the side panel top edges together and close the end panel top edges back on themselves to form an exterior flap at each end thereof. The end flaps are then folded down over the outside of the end panels and attached to the bottom thereof by snaps or Velcro (trademark) pads or other connection means. The closed compact configuration is a bag with an elongated semiround top and buttoned-down end flaps. Usually a pair of "U"-shaped straps are arranged inverted such that the straight sections of each "U" are attached to each side panel with the "U" loops extending above the top of the closed bag for grasping as a handle. The advantages of this parachute luggage are that it is light in weight as compared to solid-walled luggage, and very durable. In addition, the bag expands in proportion to the amount of material stored therein. These bags are easy to pack into an enclosed area, such as an automobile trunk, because the flexible panels are easily deformable to a variety of shapes. Side pockets and zippered pouches may be added internally or externally to increase the useable volume and provide compartmentalization when desired.

A problem has arisen with these type containers in that because the side and end panels are supple and not self-supporting, the bag collapses under its own weight to crumple the opening and interfere with proper packing. In other words, it won't stand up and remain open on its own. One is therefore reduced to holding the bag open with one hand and packing materials into it with the other hand. This sometimes causes items to be dropped and broken and/or sometimes causes articles to be caught in the collapsed bag to be later jostled or broken when the bag is again re-opened to its fullest extent.

One solution to this problem is to insert a spring wire frame in the end panels arranged to provide a sprung open configuration during loading and a folded down compact configuration when the bag is closed. Problems with this solution include the spring wire ends tearing through the cloth and the fact that these wires prohibit the bag from being washed or dry-cleaned because of the rusting that inevitably would follow. There has been some attempt at using a plastic wire frame in lieu of the spring wire frame, however, the same problems with respect to the tearing occur and in addition, the plastic wire tends to break during extended use.

This invention is a cloth parachute-type bag that, once opened to its fullest extent, will remain open until it is forcibly closed, all without the use of wire frames. It has been discovered that (1) if a center divider panel is added to the bag between the side panels and attached to the end panels so as to make the bag a two-compartment container, (2) if a sheet of material that is flexible yet has memory is added to the side panels and the divider panel, and (3) if a flat strip or strap of flexile material of heavier gauge than the end panel material is sewn into the top of the end panels near the top edge thereof, the bag may be opened and the side and end panels straightened up into an open configuration that will, when not disturbed, remain fully open so that both hands may be used to load and unload the bag. Not only are the spring wire or plastic wire frames eliminated, but the bag is now completely washable.

Accordingly, the main object of this invention is the construction of a cloth utility bag of the parachute type that will, without the use of wire frames, retain a sustained open-bag configuration when first opened to permit easier loading and unloading thereof. Other objects of this invention include a bag that is not subject to rust discoloration from the corrosive effects on the wire openers during washing, a bag that is completely washable and reusable by merely placing it in a washing machine, and a bag that may be made waterproof, decorated, or have pockets and pouches added, all without any decrease in the open-bag feature. These and other objects of the invention will become more apparent to the reader upon studying the description of the preferred embodiment and the drawings appended hereto; the protection sought by the inventor for this advance in the state-of-the-art is set forth in the claims that complete this disclosure.

DESCRIPTION OF THE PREFERRED EMBODIMENT

This invention calls for the use of cloths and sheet materials displaying a variety of characteristics that are not generally subject to standard or industrial nomenclature. Accordingly, I have undertaken herein to define these characteristics by use of ordinary words and terms which I believe best describe them. For instance, one material must be "flexible yet retentive" meaning that while it is capable of being crushed easily by hand, once released, it reverts back to a flat sheet. Another material is to be "supple" meaning easily crushed by hand and not revertable to a flat sheet or other previous form when released but then again, not incapable of use as a rather flat sheet when cut and sewn into such a configuration. Finally, I call for a "flexible" meaterial meaning that it can be bent or folded, not necessarily crushed with the hand, and it will remain in the bent or folded configuration or the last formed configuration until disturbed by a force other than gravity.

Figure 1:
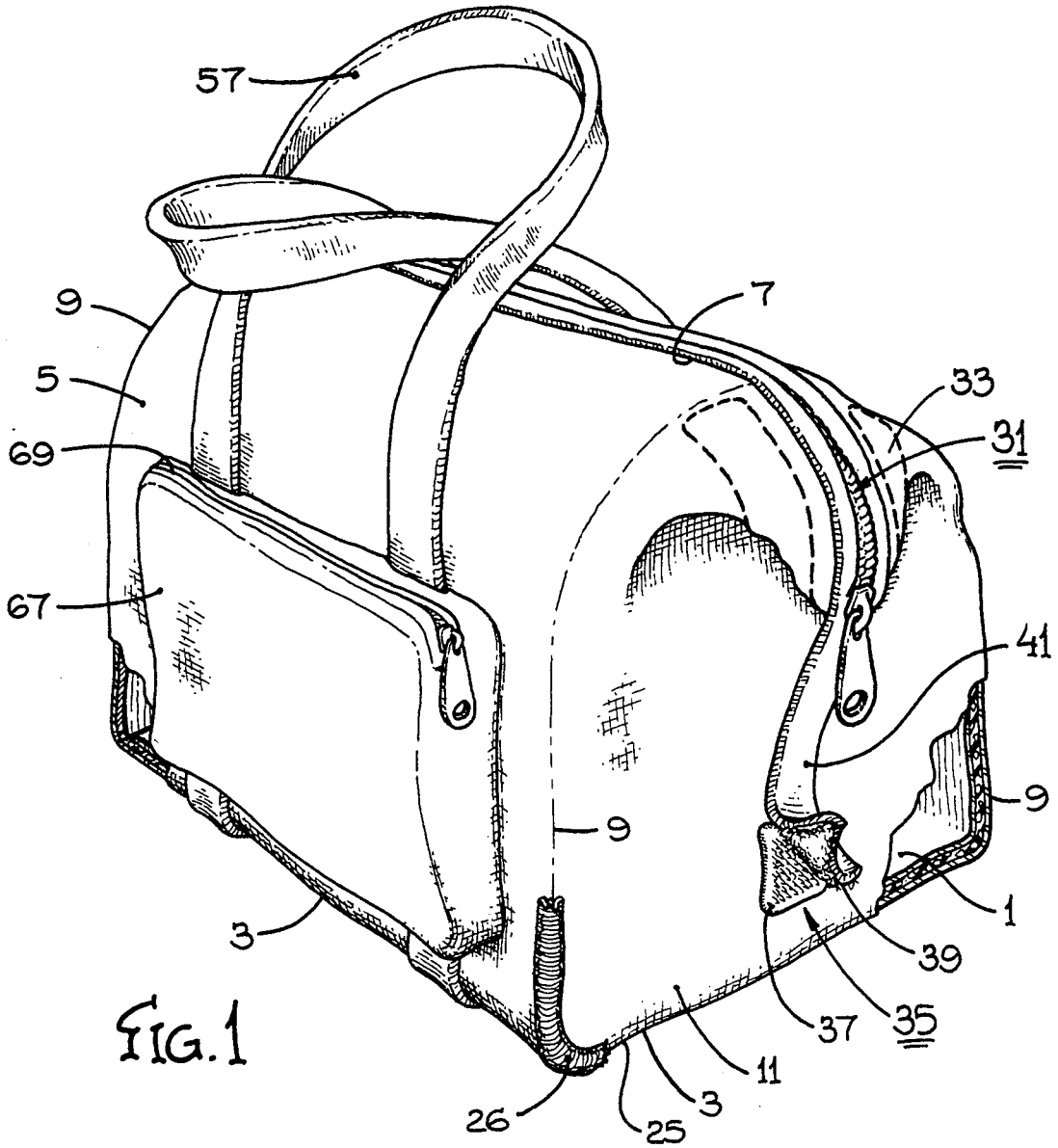
FIG. 1 is a perspective view of one embodiment of this invention showing a typical bag in its closed configuration.
Figure 2:
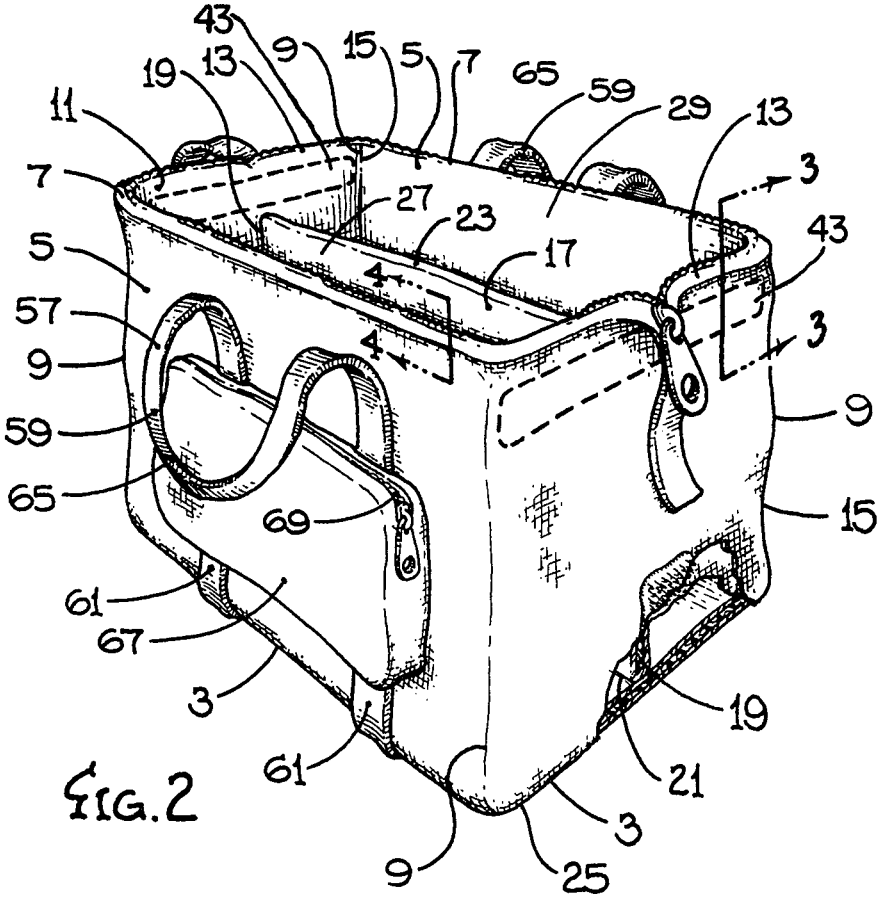
FIG. 2 is a perspective view of the same bag as FIG. 1 but in the open configuration showing location of the various elements making up the bag.

A typical bag of this invention is shown in FIGS. 1 and 2 and begins with a base 1 which is a flat sheet made from cloth or plastic that is bounded by a defined outer edge 3, usually in the shape of a rectangle however, other geometries are certainly includable within the scope herein. Preferably, base 1 is comprised of two or more layers of cloth such as a 400 or 420 denier woven nylon 8 ounce/yard cloth like Parapack (trademark)

with an interposed layer of a flexible yet retentive sheet material. There are many materials that will come within this definition; most of them are thin sheets of flexible polymeric foam such as polyethylene, polypropylene, polyurethane foams, either reticulated (opened celled) or closed cell, either fabric backed, film backed, skinned or non-skinned. One of the most useful flexible rest retentive materials is ⅛ inch thick reticulated flexible polyurethane foam having a 200 denier woven nylon/oxford cloth backing.

A pair of opposed flexible yet retentive side panels 5 extend upward from opposed portions of based outer edge 3 and are joined to base 1 by sewing, thermowelding, adhesives or by other well-known techniques. Side panels 5 terminate at respective top edges 7 and side edges 9. Preferably, side panels 5 are made in the same construction as base 1 just described, including the flexible yet retentive foam sheet.

A pair of opposed supple end panels 11 extend upward from opposed free (i.e., not taken up by side panels 5) portions of base outer edge 3 and terminate at respective top edges 13 and side edges 15. End panels 11 are also joined to base 1 by sewing, thermowelding, adhesives, or by other well-known techniques. The mutually adjacent side edges 9 and 15 of side panels 5 and end panels 11 are then joined to form the bag.

A flexible yet retentive divider panel 17 is interposed or set upright between side panels 5 and attached at its side edges 19 to end panels 11 and along its bottom edge 21 to base 1. Divider panel top edge 23 is left unattached and, in fact, top edge 23 is set below side panel top edges 7 for reasons to be explained later.

In the preferred embodiment of this invention, side panels 5 and base 1 are made in one continuous strip using outer layers of Parapack (trademark) nylon with a layer of ⅛ inch thick reticulated polyurethane cloth-backed foam placed therebetween. Side panels 5 are merely bent upward from base 1 and a welt or other narrow strip of fabric 26 is sewn along the fold line to mark the edge of base 1. Then end panels 11, made from two layers of Parapack (trademark) nylon without the interposed foam, are then moved into place and their edges 15 sewn to side panel edges 9 and then sewn along the bottom end panel edges 25 to base 3. Then, divider panel 17, constructed like base 1 and side panels 5, is sewn into place inside the bag. It is preferred that all panels and base 1 are rectangular. Also, all exposed seams are covered with a narrow strip of welt 26, a segment thereof shown in FIG. 1.

While it is probably aesthetically desired that divider panel 17 divide the bag into two equal compartments, it is by no means necessary for the operation of this invention. Panel 17 should, however, divide the bag into two large compartments and, as shown in FIG. 2, panel 17 does form large compartments 27 and 29 respectively.

Along panel top edges 7 and 13 is a closure means 31 for joining together side panels 5, along their total top edge, and for simultaneously closing each end panel top edge 13 over onto itself to form an exterior or outwardly pointing end flap 33. End flaps 33 may then be folded down over the outside of end panels 5 and temporarily attached to the lower part thereof by means 35, shown in FIG. 1 as a Velcro (trademark) pad, one piece 37 attached to end panel 5 and the other piece 39 attached to the underside end of a cloth strip 41 carrying closure means 31. As shown, attachment means 31 is a zipper, preferably a nylon coil zipper, however, other closure means such as Velcro (trademark) and snap or buttons may be used.

When the bag is to be closed, side panel top edges 7 are moved together and end panel top edges 13 are folded over onto themselves and the zipper closed. At the same time side panel top edges 7 are pushed downward to contact divider panel top edge 23. When fully closed and end flaps 33 fastened, the bag will have a rounded top appearance and a height near that of divider panel 17; that is the reason for the relative shortness of height of divider panel 17.

Figure 3:
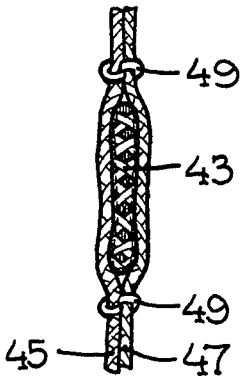
FIG. 3 is a sectional view through a portion of an end panel taken along lines 3—3 in FIG. 2.

A flat strip or strap or narrow, elongated length 43 of flexile material, of heavier gauge than end panel 11 is attached to end panel 11 near its top edge 13 and extends therealong from side edge 15 to side edge 15 to provide the sustained open-bag configuration to this bag when it is opened, the panels vertically set or arranged by hand and strips 43 are straightened with the fingers by pulling at the ends thereof. sewn or glued directly onto end panels 11 but in the preferred embodiment shown in FIG. 3, strap 43 is interposed two layers 45 and 47 of Parapack (trademark) nylon cloth making up end panel 11 and held in place by parallel lines 49 of stitching. A preferred flexile material is woven polypropylene strap 1½ inches in width.

Figure 4:
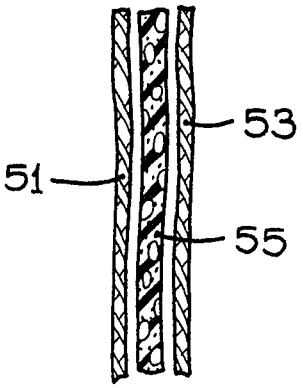
FIG. 4 is a sectional view through a portion of a side panel taken along lines 4—4 in FIG. 2.

FIG. 4 shows a typical cross-section of the flexible yet retentive panel and shows spaced-apart cloth layers 51 and 53 with a layer 55 of flexible yet retentive sheet material held therebetween.

A handle 57 is provided for carrying the bag. As shown in FIGS. 1 and 2, handle 57 comprises a pair of straps 59 of finite length arranged in an inverted U-shape configuration with their straight segments 61 sewn or attached to side panels 5 and their intermediate U-shaped segments 65 extending above closure means 31 for grasping. A pouch 67 is shown affixed to the outside of side panel 5 and is enterable through zipper 69. These additions may be made to the bag without detracting from the open configuration achieved through the use of this invention.

I claim:

1. A collapsable and machine washable utility bag comprising:

(a) a flat yet flexible base defining an enclosed outer edge;

(b) a pair of opposed flexible yet retentive side panels, extending upward for vertical positioning from opposed portions of said base outer edge, having respective top and side edges;

(c) a pair of opposed supple end panels, extending upward from opposed free portions of said base outer edge, having respective top and side edges and joined to said side panels along their mutually adjacent side edges and being arranged to be straightened vertically upward along with said side panels to form an open-bag configuration;

(d) a flexible yet retentive divider panel interposed and shorter than said side panels having opposed side edges attached to said end panels and arranged to form a two-compartment bag;

(e) flexible means for closing said bag by joining said side panel top edges together and closing each said end panel top edge over onto itself to form exterior end flaps that may be folded down and attached lower onto said end panels to form a compact bag configuration; and, (f) a flat strip of flexile material of heavier gauge than said end panel attached to said end panels near the top edges thereof and extending therealong to sustain said open-bag configuration when said bag is opened, said panels vertically arranged and said strips straightened.

2. The utility bag of claim 1 wherein said base comprises at least two layers of cloth having at least one layer of flexible yet retentive sheet material enclosed therebetween.

3. The utility bag of claim 1 wherein said side panels are comprised of at least two layers of cloth having a layer of flexible yet retentive sheet material enclosed therebetween.

4. The utility bag of claim 1 wherein said end panels are comprised of at least two layers of cloth wherein said flat strip is enclosed therebetween.

5. The utility bag of claim 1 wherein said top and said side edges of said panels are covered with a welt.

6. The utility bag of claim 1 including a bag handle comprised of a pair of straps of finite length arranged in an inverted U-shaped configuration wherein the straight segments of each U are attached to one of each said side panels and the intermediate U-shaped segments extend above said closure means for grasping.

7. The utility bag of claim 1 wherein said base defines a flat rectangular outline.

8. The utility bag of claim 1 wherein said side panels and said end panels are rectangular in shape.

9. The utility bag of claim 2 wherein said cloth is 400 denier woven nylon 8 ounces/yard.

10. The utility bag of claim 3 wherein said cloth is 400 denier woven nylon 8 ounces/yard.

11. The utility bag of claim 4 wherein said cloth is 400 denier woven nylon 8 ounces/yard.

12. The utility bag of claim 3 wherein said flexible yet retentive sheet material is $\frac{1}{8}$ inch thick reticulated flexible polyurethane foam having a 200 denier woven nylon/oxford cloth backing.

13. The utility bag of claim 4 wherein said strip material is $1\frac{1}{2}$ inch wide polypropylene strap.

14. A collapsable and machine washable utility bag comprising:

(a) a flat yet flexible rectangular base comprising two layers of cloth having a layer of flexible yet retentive sheet material enclosed therebetween defining an enclosed outer edge;

(b) a pair of opposed flexible yet retentive side panels comprising two layers of cloth having a layer of flexible yet retentive sheet material enclosed therebetween extending upward for vertical positioning from opposed portions of said base outer edge having respective top and side edges;

(c) a pair of opposed supple end panels comprising two layers of cloth extending upward from opposed free portions of said base outer edge having respective top and side edges and joined to said side panels along their mutually adjacent side edges and being arranged to be straightened vertically upward along with said side panels to form an open-bag configuration;

(d) a flexible yet retentive divider panel comprising two layers of cloth having a layer of flexible yet retentive sheet material enclosed therebetween interposed and shorter than said side panels having opposed side edges attached to said end panels and arranged to form a two-compartment bag;

(e) flexible means for closing said bag comprising a zipper adjacent said panel top edges for joining said side panel top edges together and closing each said end panel top edge over onto itself to form opposed exterior end flaps that may be folded down and attached lower onto said end panels to form a compact bag configuration;

(f) a flat strip of flexile material of heavier gauge than said end panel cloth interposed said end panel cloth layers near the top edges thereof and extending therealong to sustain said open-bag configuration when said bag is opened, said panels vertically arranged and said strips straightened; and, (g) a bag handle comprising a pair of straps of finite length partially attached to the exterior of said bag and arranged to form a pair of inverted U-shaped loops extending above said zipper, one loop on each side thereof, for grasping.

* * * * *

UNITED STATES PATENT AND TRADEMARK OFFICE

CERTIFICATE OF CORRECTION

PATENT NO. : 4,563,525

DATED : January 7, 1986

INVENTOR(S) : James B. Campbell

It is certified that error appears in the above—identified patent and that said Letters Patent is hereby corrected as shown below:

Column 14, line 63: "locks" should be "licks".

Column 30, line 52: "development" should be "developed".

Column 33, lines 34-35: "5-4°-70° should be "54°-70°".

Column 39, line 37: after 26.7 insert "g".

Column 39, line 38: after "170" insert "ml".

Column 42, line 11: after "n=1," insert "$R^7$=H,".

Signed and Sealed this

*Twenty-third* Day of *September 1986*

[SEAL]

*Attest:*

DONALD J. QUIGG

*Attesting Officer*

*Commissioner of Patents and Trademarks*